US005259267A

United States Patent [19]

Jurewicz

[11] Patent Number: 5,259,267

[45] Date of Patent: Nov. 9, 1993

[54] AUTOMATIC CONTROL DEVICE HAVING A MULTI-ELEMENT KNOB

[76] Inventor: Michal Jurewicz, 142 E. 27th St., New York, N.Y. 10016

[21] Appl. No.: 882,758

[22] Filed: May 11, 1992

Related U.S. Application Data

[63] Continuation-in-part of Ser. No. 524,289, May 14, 1990, abandoned.

[51] Int. Cl.[5] ..... G05G 1/10

[52] U.S. Cl. ..... 74/553; 74/557; 16/121

[58] Field of Search ..... 74/553, 557, 523, 528; 16/121

[56] References Cited

U.S. PATENT DOCUMENTS 4,532,817 8/1985 Chaki ..... 74/553 X
4,561,565 12/1985 Wolf et al. ..... 74/553 X
4,779,305 10/1988 Gorsek ..... 16/121
4,920,823 5/1990 Mohr et al. ..... 74/553
4,947,097 8/1990 Tao ..... 74/553

FOREIGN PATENT DOCUMENTS 0076619 5/1982 Japan ..... 74/553

*Primary Examiner*—Vinh T. Luong
*Attorney, Agent, or Firm*—Klaus P. Stoffel

[57] ABSTRACT

A control device including a knob made of at least two independently rotatable elements, including a manually operable element and a driven element, the driven element having a position marker, a driver for rotating the further element, a reader for reading an amount which the manually operable element is rotated, and a processor for controlling the driver based upon the reading of the reader.

5 Claims, 2 Drawing Sheets

AUTOMATIC CONTROL DEVICE HAVING A MULTI-ELEMENT KNOB

This is a continuation-in-part application of Ser. No. 07/524,289, filed May 14, 1990, abandoned.

BACKGROUND OF THE INVENTION

In recent years, many electronic appliances, both consumer and professional, have been automated. This means that many functions that are controlled by the use can also be controlled by an internal program of the appliance. In older non-automated appliances, rotary potentiometers were used to control many functions. Automation of a unit requires the use of knobs or buttons that allow an automated change of parameters and would also work as manual controls. Traditional potentiometers usually cannot be used because they can be set only by an operator. Users are accustomed to a traditional form of a knob as a control device. By turning the knob, a user can increase or decrease the setting of a parameter. An automated control device should work in a similar way. There are several solutions presently being used, all of which have various disadvantages.

One automated design is an array of "up and down" push-buttons. The basic disadvantage of the present automated solutions is the inability to indicate the current position of the control as is possible with traditional potentiometers. In traditional potentiometers, the actual position of the knob is shown by a marker. This allows the user to determine how the control is set. Nothing similar is possible with push-buttons, unless an additional display is provided.

Another example of an automated control is a motorized potentiometer. A motorized potentiometer has the disadvantage that a driving motor is mechanically coupled with the potentiometer shaft. Therefore, there are two factors determining knob position, namely, the user and the motor. This complicates the additional circuitry and makes the whole product very unreliable and expensive.

A third known design of automated control is a rotary multipositional switch with no mechanical stop, surrounded by light emitting diodes (LED) With this control, the user turns the switch and the position of the switch is shown by one of the LEDs, which is activated by associated electronics. This construction has the disadvantages of high cost and inconvenient and unclear reading.

SUMMARY OF THE INVENTION

Accordingly, it is an object of the present invention to provide a control which combines advantages of a traditional knob with an easy automated setting of knob position.

Pursuant to this object, and others which will become apparent hereafter, one aspect of the present invention resides in a control device having a knob made up of at least two independently rotatable elements, namely, a knob body and a knob cap. The device further includes a reader and a driver that have coaxial independently revolving shafts, similar to a double-shafted potentiometer. The reader shaft is mechanically coupled to the knob body, while the driver shaft is coupled to the knob cap.

The shafts are freely movable independently of each other without mechanical interference therebetween, as are the knob cap and knob body.

The knob body is manually set by an operator, and the knob cap has a position marker which shows the operator the "subjective" position of the knob. The reader reads the actual position or movement of the knob body and sends this data to an electronic circuit. The circuit puts out corresponding data which is read by the driver, which in turn sets the position of the knob cap.

The cap and body have no mechanical stop, i.e., they can revolve without restraint. Data outgoing from the reader is processed by the electronic circuit and may differ from data incoming to the driver. This means that the movement of cap does not necessarily have to follow the movement of the knob body. It is only the electronic circuit that determines the cap position setting, and it is only the operator who can move the knob body. This separation of functions of the knob body and the knob cap is essential for the invention.

DETAILED DESCRIPTION OF THE PREFERRED EMBODIMENTS

Figure 1:
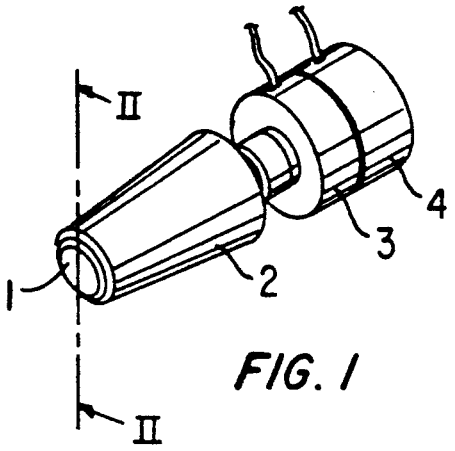
FIG. 1 is a perspective view of a control device pursuant to the present invention.
Figure 2:
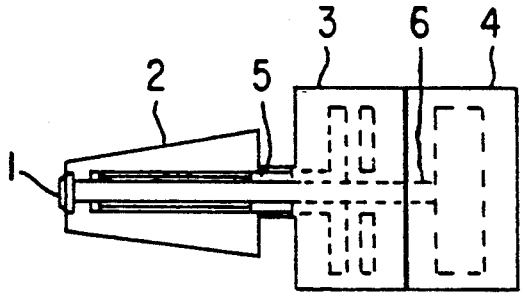
FIG. 2 is a section along the line II—II of FIG. 1.
Figure 3:
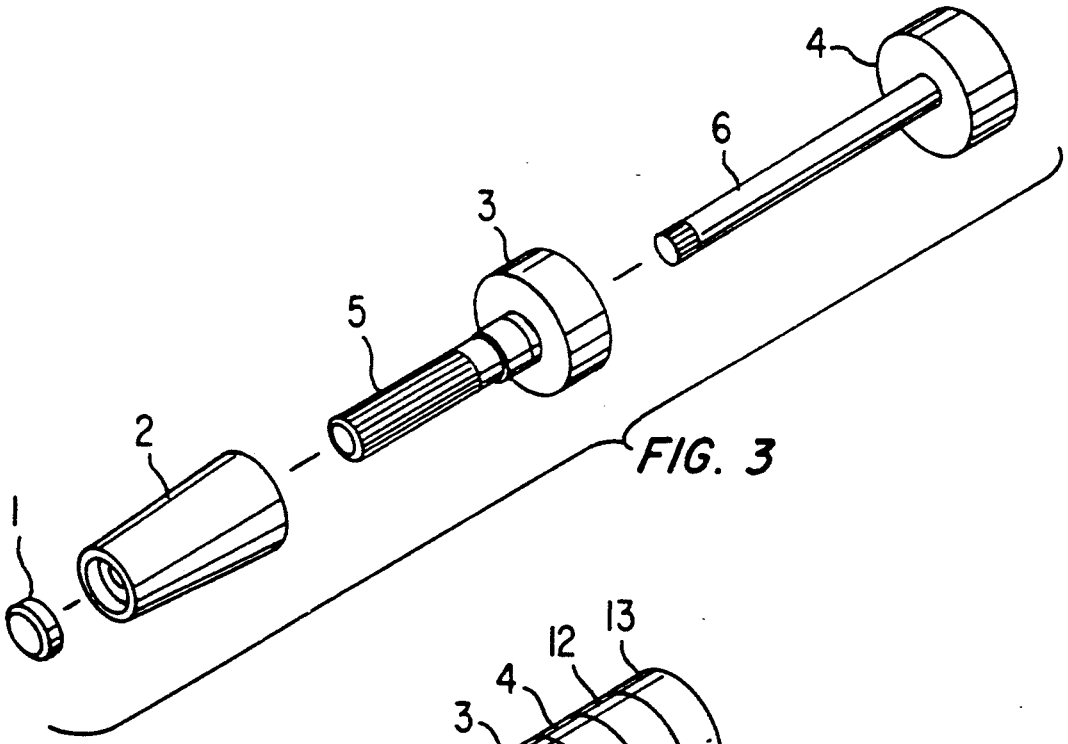
FIG. 3 is an exploded view of the device of FIG. 1.

FIGS. 1–4 illustrate a control device having a plastic knob body 2 with an independent cap 1, a reader 3, and a driver 4. The reader 3 is an optical encoder having a radially striped disk with an opto-electronic device capable of reading the movement of the disk and its direction. The knob body 2 is connected with the reader 3 by a shaft 5, and the disk is attached to the shaft 5 so that the reader 3 reads the movement of the knob body 2.

The driver 4 is a miniature stepper motor attached to the cap 1 by a shaft 6. A circuit 7 is provided between the reader 3 and the driver 4. The circuit 7 receives data from the reader 3 and feeds corresponding data to the driver 4.

Figure 6:
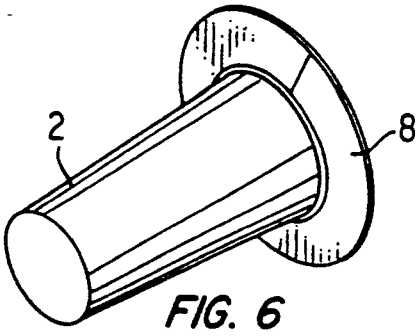
Figures 5A, 5B, 5C:
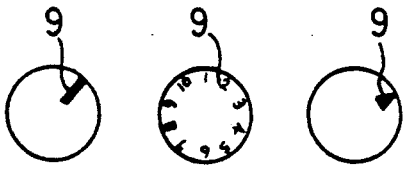
Figure 6A:
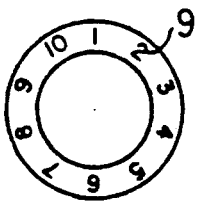
Figure 6B:
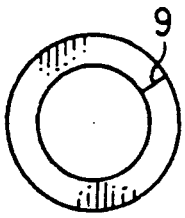

The two element knob having a knob can be used for a wide variety of applications, and can be designed in several ways. For example, the cap 1 does not have to be the element moved by the driver 4. As shown in FIG. 6, a ring 8 at the bottom of the knob body 2 can take the place of the cap 1. The ring 8 can also be situated at any other point along the knob body 2.

As FIGS. 5–5*c*, 6*a* and 6*b* show, a marker 8 is provided on the cap 1 or ring 8 to show position of the knob 2.

Figure 7:
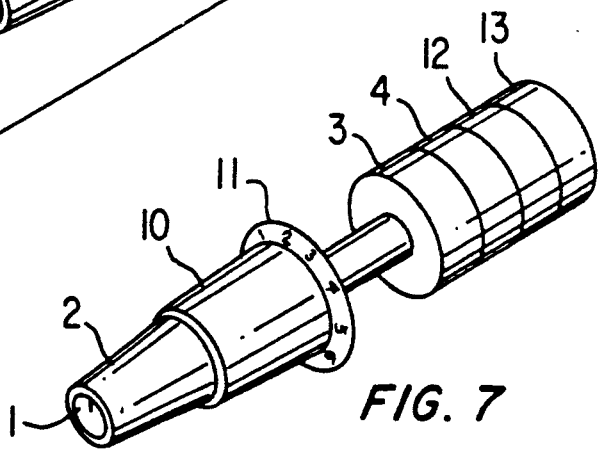
FIG. 7 is a view similar to FIG. 1, of an additional embodiment of the control device.
Figure 4:
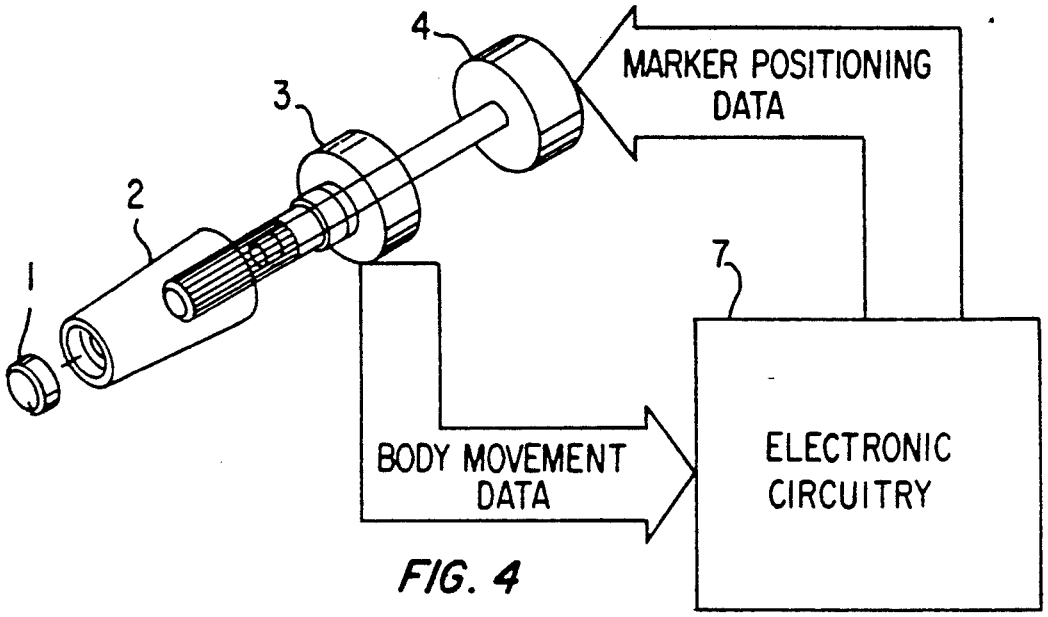
FIG. 4 schematically illustrates the flow of data in the device.
Figure 5:
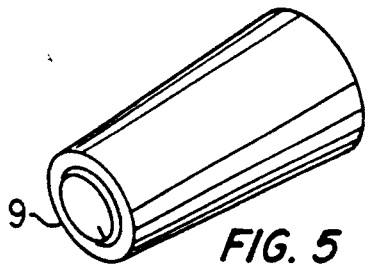
FIGS. 5–6*b* show various embodiments of the knob and cap.

FIG. 7 shows an embodiment having an additional knob 10 and an additional cap 11 which are respectively connected to a reader 13 and a driver 12 by independent shafts coaxial with shafts 5, 6. Such a multiple arrangement operates on the same principle as the arrangement in FIG. 1.

What is claimed as new and desired to be protected by Letters Patent is set forth in the appended claims:

1. A control device, comprising:

a knob having at least two coaxial individually revolvable elements, including a manually operable element and a driven element, the driven element having a position marker;

reading means for reading an amount which the manually operable is rotated;

driving means for rotating the driven element; and processor means for controlling said driving means based upon readings of said reading means.

2. A control device as defined in claim 1, wherein the processor means is an electronic circuit.

3. A control device as defined in claim 1, wherein the manually operable element is a knob body, and the driven element is a knob cap.

4. A control device as defined in claim 1, wherein the revolvable elements revolve with no mechanical stop.

5. A control device as defined in claim 1, wherein the knob has four coaxial independently revolvable elements, including two manually operable elements and two driven elements, wherein the reading means reads an amount which a first of the manually operable elements is rotated, said driving means rotating a first of the driven elements, and further comprising additional reading means for reading an amount which a second of the manually operable elements is rotated, and additional driving means for rotating a second of the driven elements, said processor means controlling each of said driving means based upon readings of said respective reading means.

* * * * *